United States Patent [19]

Bow et al.

[11] Patent Number: 4,981,365

[45] Date of Patent: Jan. 1, 1991

[54] MIXING AND DISPERSING APPARATUS

[75] Inventors: Colin F. Bow, Loggerheads; Robert W. English, Lichfield, both of England

[73] Assignee: Netzsch Mastermix Limited, United Kingdom

[21] Appl. No.: 380,121

[22] Filed: Jul. 14, 1989

[30] Foreign Application Priority Data

Jul. 15, 1988 [GB] United Kingdom ..... 8816909

[51] Int. Cl.[5] ..... B01F 13/06

[52] U.S. Cl. ..... 366/139; 366/314

[58] Field of Search ..... 366/139, 150, 151, 153, 366/165, 167, 168, 279, 314, 205

[56] References Cited

U.S. PATENT DOCUMENTS

| | | | |
|---|---|---|---|
| 4,444,508 | 4/1984 | Kreuer | 366/139 |
| 4,486,100 | 12/1984 | Endo | 366/139 |
| 4,653,568 | 3/1987 | Baldelli | 366/139 |

*Primary Examiner*—Robert W. Jenkins

*Attorney, Agent, or Firm*—Learman & McCulloch

[57] ABSTRACT

A mixing and dispersing apparatus is shown in FIG. 1 having a supply line 32 to deliver powder to the vessel and open it near the base of the vessel so as to be below the normal liquid level in the vessel. The top of the vessel is connected to a vacuum source and the valve is arranged to be open only when pressure in the vessel is below a predetermined minimum and to close automatically when the pressure rises above that minimum.

4 Claims, 1 Drawing Sheet

MIXING AND DISPERSING APPARATUS

This invention relates to mixing and dispersing apparatus. Such apparatus is used (by way of example) in the manufacture of paint, when one or more powders are mixed and dispersed in solvent. These powders are (in the case of paint) opacifiers and/or pigments.

The apparatus comprises a vessel and at least one rotor. There may be a slow speed rotor having a relatively large blade which sweeps the sides and base of the vessel to maintain a general circulation of contents, together with one or more small diameter high speed rotors which are active in a localised area so as to provide a higher degree of mixing and dispersing in that area.

It has been suggested in Ep 0 291 209A to provide a sealed vessel connected to a vacuum so that the space above the liquid may be evacuated and connect the vessel to a source of the powders at the base of the vessel. The powders may then be vacuum induced below the liquid level—this is to avoid for example the environmental pollution caused when bags of fine powder are tipped into the vessel, which was and still is common practice.

However, this vacuum induction method has led to difficulties when liquid from the vessel enters the supply line and causes clogging and possibly encourages the formation of lumps in the powder. When such lumps are vacuum induced, those lumps may travel completely through the liquid and even enter the vacuum system without being wetted and dispersed in the apparatus.

The object of the invention is to provide improvements and avoid these difficulties.

According to the invention, mixing and dispersing apparatus comprises a closed vessel and one or more rotors for mixing and dispersing powder in liquid contained in the vessel, and has the vessel connected to a vacuum source above the normal liquid level and to a powder source below the normal liquid level and is characterised by the provision of a valve in the powder supply line which opens and closes according to the vacuum in the vessel.

Hence, the valve will be closed until the vacuum level is sufficient to ensure that the liquid is lifted away from the entry point of the pipeline in the vessel. Then, when the valve opens, there is no possibility of the liquid entering the line. If the vacuum level falls to a point where there is a risk of the liquid entering the pipe, the valve will automatically re-shut.

The valve may be spring driven to the closed position and opened directly by the vacuum. Alternatively the vacuum may be sensed and a signal sent to operate a motor for valve opening.

According to a preferred feature of the invention the pipeline is to run in a straight line from the side wall of the vessel to the powder source, and the pipeline may be horizontal or only slightly inclined to the horizontal.

The vessel may have an internally convex base and preferably the supply line opens near the lowest point of the side wall.

The preferred form of valve is a slide valve comprising a plate movable generally perpendicularly to the axis of the supply line. Preferably also the supply line is of generally uniform diameter over a portion oF its length and then increases in diameter towards the valve.

One embodiment of the invention is now more particularly described with reference to the accompanying drawings wherein.

Figure 1:
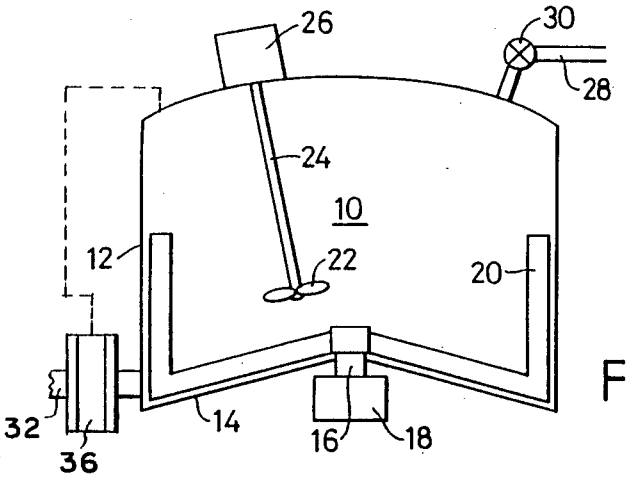
FIG. 1 is diagrammatic view of the mixing and dispersing apparatus.

Turning now to the drawings, the vessel 10 has a generally cylindrical side wall 12 and an internally convex (or conical) base 14. Centrally located shaft 16 is driven from a motor iB and carries a slow speed sweep rotor 20 which closely conforms to the internal shape and is for the purpose of providing a general circulation of the contents of the vessel in operation. One or more high speed rotors 22 are provided mounted on individual shafts 24 connected to motors 26. These may be arranged to alloW the high speed rotor to be raised and lowered from time to time, in conventional fashion. The vacuum line 28 is connected through a valve 30 opening to the top of the vessel. Supply line 32 for powders opens via a vacuum controlled valve 36 through the side wall of the vessel near the lowest point of the same.

Figure 2:
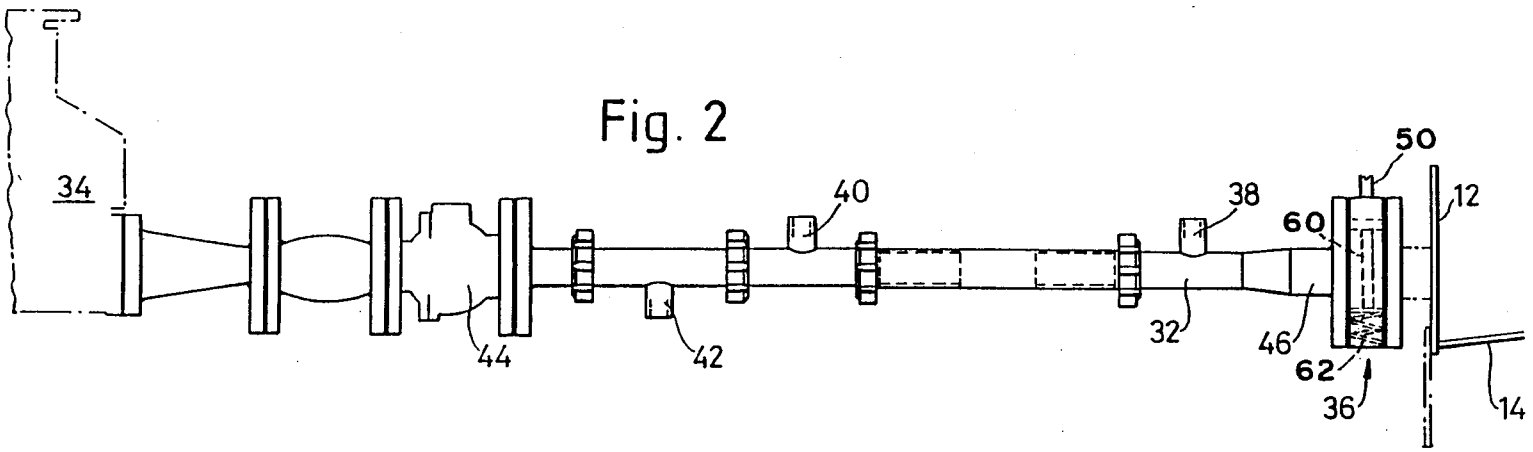
FIG. 2 is an elevation of the supply line for the same.

Turning now to FIG. 2, the supply line extends in a straight line from the vessel side wall to the powder storage compartment 34. The valve 36 is located as close to the side wall as possible and is of the kind comprising a plate or shutter 60 that is reciprocable perpendicularly to the supply line itself. The plate is urged to its closed position by a tension spring 62 and is movable to its opened position in response to vacuum transmitted via a vacuum line 50. The plate may have a knife edge and move across the valve seat so as to scrape the same clean of any residue of powder when the valve closes.

The supply line is also provided with a connection 38 for a vacuum gauge, a further connection 40 for a vacuum switch, and another connection 42 for a compressed air supply for the purpose of fluidising the powder and feeding it through the line into the vessel. A ball valve 44 is used to isolate the system for example for maintenance purposes. The terminal portion of the supply line adjacent the valve at 46 is of larger diameter than the main length of the line for the purpose mentioned.

In use the operator may apply vacuum when a powder addition is to be made. When the vacuum is sufficiently high to lift the vessel contents from the supply line area, which will in general depend upon design parameters but may be, e.g. minus 0.3 bar, the valve 36 will automatically open. If admission of powder with fluidising compressed air lowers the vacuum below that pressure set (and adjustable) valve, the valve will automatically re-close.

We claim:

1. Mixing apparatus comprising a closed vessel; at least one rotor for mixing a powder with a liquid contained at a normal level in said vessel; means above the normal level of liquid in said vessel for connecting said vessel to a vacuum source; means below the normal level of liquid in said vessel for connecting said vessel to a source of powder; and valve means responsive to the presence and absence of a predetermined vacuum in said vessel for respectively opening and closing said valve means to enable and disable the flow of powder from said source into said vessel.

2. Apparatus according to claim 1 including spring means acting on said valve means and biasing the latter to its closed position.

3. Apparatus according to claim 2 wherein the means connecting said vessel to the powder source includes a supply line and wherein said valve means is accommodated in said supply line immediately adjacent the exterior of said vessel.

4. Apparatus according to claim 3 wherein said valve means comprises a slideable plate movable transversely of said supply line.

* * * * *